US010838340B2

(12) United States Patent
Noguchi

(10) Patent No.: US 10,838,340 B2
(45) Date of Patent: Nov. 17, 2020

(54) IMAGE FORMING APPARATUS

(71) Applicant: CANON KABUSHIKI KAISHA, Tokyo (JP)

(72) Inventor: Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/460,694

(22) Filed: Jul. 2, 2019

(65) Prior Publication Data

US 2020/0019102 A1 Jan. 16, 2020

(30) Foreign Application Priority Data

Jul. 10, 2018 (JP) ..... 2018-131067

(51) Int. Cl.
*G03G 15/00* (2006.01)
*G03G 21/20* (2006.01)

(52) U.S. Cl.
CPC ..... *G03G 15/5016* (2013.01); *G03G 21/206* (2013.01)

(58) Field of Classification Search
CPC ..... G03G 15/55; G03G 15/553; G03G 21/206
See application file for complete search history.

(56) References Cited

U.S. PATENT DOCUMENTS 6,694,108 B2 * 2/2004 Hirose ..... G03G 15/50 399/44
2009/0052933 A1 * 2/2009 Sata ..... G03G 21/206 399/92
2017/0277232 A1 * 9/2017 Yamashita ..... G05D 23/1917
2019/0310572 A1 * 10/2019 Nakao ..... G03G 15/16
2020/0023301 A1 * 1/2020 Ge ..... B01D 46/442

FOREIGN PATENT DOCUMENTS

JP 9-138618 A 5/1997
JP 2000-200016 A 7/2000
JP 2005-181389 A 7/2005
JP 2006-113341 A 4/2006
JP 5451887 B2 3/2014

* cited by examiner

*Primary Examiner* — Carla J Therrien
(74) *Attorney, Agent, or Firm* — Canon U.S.A., Inc. I.P. Divison

(57) ABSTRACT

An image forming apparatus includes an image forming unit, an image heating device, a filter, a display unit, and a controller. When an image forming operation of the image forming unit starts and an ambient temperature outside the image forming apparatus is a first temperature, the controller sets, after the image forming operation starts, a first period that begins after detected ambient temperature inside the image forming apparatus reaches a predetermined temperature and ends when filter replacement information is displayed on the display unit. When the image forming operation starts and the outside ambient temperature is a second temperature higher than the first temperature, the controller sets, after the image forming operation starts, a second period that is shorter than the first period and begins after the detected inside ambient temperature reaches the predetermined temperature and ends when the filter replacement information is displayed on the display unit.

6 Claims, 9 Drawing Sheets

IMAGE FORMING APPARATUS

BACKGROUND

Field

The present disclosure relates to an image forming apparatus including a filter.

Description of the Related Art

With the operation of an image forming apparatus, a device (image heating device) for heating toner images transferred onto a recording material to fix the toner images to the recording material rises in temperature. At this time, air in space inside the image forming apparatus (hereinafter referred to as "inside the apparatus") is warmed by heat generated from the image heating device, and the ambient temperature inside the apparatus rises. Then, as the extent of the rise in the ambient temperature inside the apparatus is greater, developing devices are warmed more. Then, the temperatures of developer stored in the warmed developing devices become high. Generally, developer is weak against heat. More specifically, when heat continues to be applied to the developer, toner in the developer clumps, and the fluidity of the developer becomes low. If the fluidity of the developer becomes low, the quality characteristics of the developer decrease. This may deteriorate image quality.

Therefore, to reduce the extent of the rise in the ambient temperature inside the apparatus, for example, the discharge of the warmed air inside the apparatus to space outside the image forming apparatus (hereinafter referred to as "outside the apparatus") is considered. More specifically, while a duct including an opening (a discharge opening) for discharging warmed air inside the apparatus to outside the apparatus is provided inside the apparatus, an air exhaust fan for exhausting the warmed air inside the apparatus is connected to the duct. Then, the air exhaust fan is caused to operate during the operation of the image forming apparatus. Thus, the warmed air inside the apparatus is exhausted via the discharge opening of the duct using the air exhaust fan. This reduces the extent of the rise in the ambient temperature inside the apparatus.

Meanwhile, floating substances such as paper dust and toner exist inside the apparatus. Thus, when the warmed air inside the apparatus is exhausted via the discharge opening of the duct using the air exhaust fan, it is necessary to prevent these floating substances from being discharged to outside the apparatus via the discharge opening of the duct. To this end, a technique is known in which a filter for collecting floating substances is provided between the discharge opening of the duct and the air exhaust fan to collect floating substances that are to pass through the filter.

However, as the amount of floating substances collected by the filter increases, the extent of the progress of the clogging of the filter becomes greater. Thus, air is less likely to pass through the filter. As a result, even if an attempt is made to exhaust the warmed air inside the apparatus via the discharge opening of the duct using the air exhaust fan, the warmed air inside the apparatus cannot pass through the filter and tends to stagnate on the near side of the filter. This means that the efficiency of exhausting warmed air inside the apparatus through the discharge opening of the exhaust air duct using the air exhaust fan decreases. Thus, the efficiency of suppressing the rise in the ambient temperature inside the apparatus decreases. Thus, in a case where the extent of the progress of the clogging of the filter is great, it is necessary to replace the filter at an appropriate timing.

Japanese Patent Application Laid-Open No. 2006-113341 discusses a configuration in which a threshold for the number of formed images as the life of a filter is set based on the average value of the image ratio or the average value of the toner density from the time of the replacement of a filter to the current time, and if the number of formed images reaches the set threshold, a warning is displayed.

In the configuration discussed in Japanese Patent Application Laid-Open No. 2006-113341, the state of decrease in the charging performance of toner is estimated based on the average value of the image ratio or the average value of the toner density from the time of the replacement of a filter to the current time, and the life of a filter is estimated based on the fact that scattered toner increases with a decrease in the charging performance of the toner. Since such a configuration is based on estimations, even though the extent of the progress of the clogging of the filter is not actually great, an apparatus may determine that the filter reaches the end of its life, and the apparatus may display a warning. Further, since such a configuration is based on the prediction, conversely, even though the extent of the progress of the clogging of the filter is actually great, the apparatus may determine that the filter does not yet reach the end of its life, and the apparatus does not display a warning. Therefore, to effectively use the filter until the filter reaches the end of its life, it is desirable to urge a user to replace the filter at an appropriate timing, taking into account whether the extent of the progress of the clogging of the filter has a tendency to be actually great.

Japanese Patent Application Laid-Open No. 2005-181389 discusses a configuration in which a device (pressure drop measurement device) for measuring the difference between the pressure of air before passing through a filter and the pressure of the air after passing through the filter is separately provided inside an apparatus. In the configuration discussed in Japanese Patent Application Laid-Open No. 2005-181389, if it is detected based on the measurement result of the pressure drop measurement device that a large pressure drop occurs before and after the air passes through the filter, it is estimated that the extent of the progress of the clogging of the filter is great. This pressure drop measurement device is separately provided inside the apparatus in order only to grasp the pressure drop before and after air passes through the filter. Thus, in the configuration discussed in Japanese Patent Application Laid-Open No. 2005-181389, it is necessary to provide space to install the pressure drop measurement device inside the apparatus. This makes the apparatus larger.

SUMMARY

The present disclosure is directed to an image forming apparatus that, to suppress the rise in "the ambient temperature inside an image forming apparatus", urges a user to replace a filter at an appropriate timing, taking into account both "the ambient temperature outside the image forming apparatus" and "the ambient temperature inside the image forming apparatus".

According to an aspect of the present disclosure, an image forming apparatus includes an image forming unit configured to execute an image forming operation to form a toner image and including an image bearing member and a developing device, wherein the developing device is configured to accommodate developer containing toner and to develop, using the developer, an electrostatic latent image formed on the image bearing member, an image heating device configured to fix a toner image onto the recording material by heating the toner image transferred from the image forming unit onto a recording material, a duct provided around the image heating device and including a discharge opening for discharging air inside the image forming apparatus to outside the image forming apparatus, an air exhaust fan connected to the duct and configured to exhaust the air inside the image forming apparatus to discharge the air inside the image forming apparatus to outside the image forming apparatus via the discharge opening, a filter provided between the discharge opening and the air exhaust fan and configured to collect a floating substance, a detection unit configured to detect an ambient temperature inside the image forming apparatus, a display unit, and a controller configured to control the display unit, based on information regarding the detected ambient temperature inside the image forming apparatus, so that information regarding replacement of the filter is displayed on the display unit, wherein, when the image forming operation of the image forming unit starts and an ambient temperature outside the image forming apparatus is a first temperature, the controller sets, after the image forming operation of the image forming unit starts, a first period that begins after the detected ambient temperature inside the image forming apparatus reaches a predetermined temperature and ends when the information regarding the replacement of the filter is displayed on the display unit, and wherein, when the image forming operation of the image forming unit starts and the ambient temperature outside the image forming apparatus is a second temperature higher than the first temperature, the controller sets, after the image forming operation of the image forming unit starts, a second period that is shorter than the first period and begins after the detected ambient temperature inside the image forming apparatus reaches the predetermined temperature and ends when the information regarding the replacement of the filter is displayed on the display unit.

Further features of the present disclosure will become apparent from the following description of exemplary embodiments with reference to the attached drawings.

DESCRIPTION OF THE EMBODIMENTS

With reference to the attached drawings, exemplary embodiments of the present disclosure will be described in detail below. The following exemplary embodiments is not intended to limit the present disclosure according to the appended claims, and not all the combinations of the features described in a first exemplary embodiment are essential for a method for addressing the issues in the present disclosure. The present disclosure can be carried out in various applications such as a printer, a printing machine, a copying machine, a fax, and a multifunction peripheral.

<Configuration of Image Forming Apparatus>

Figure 1:
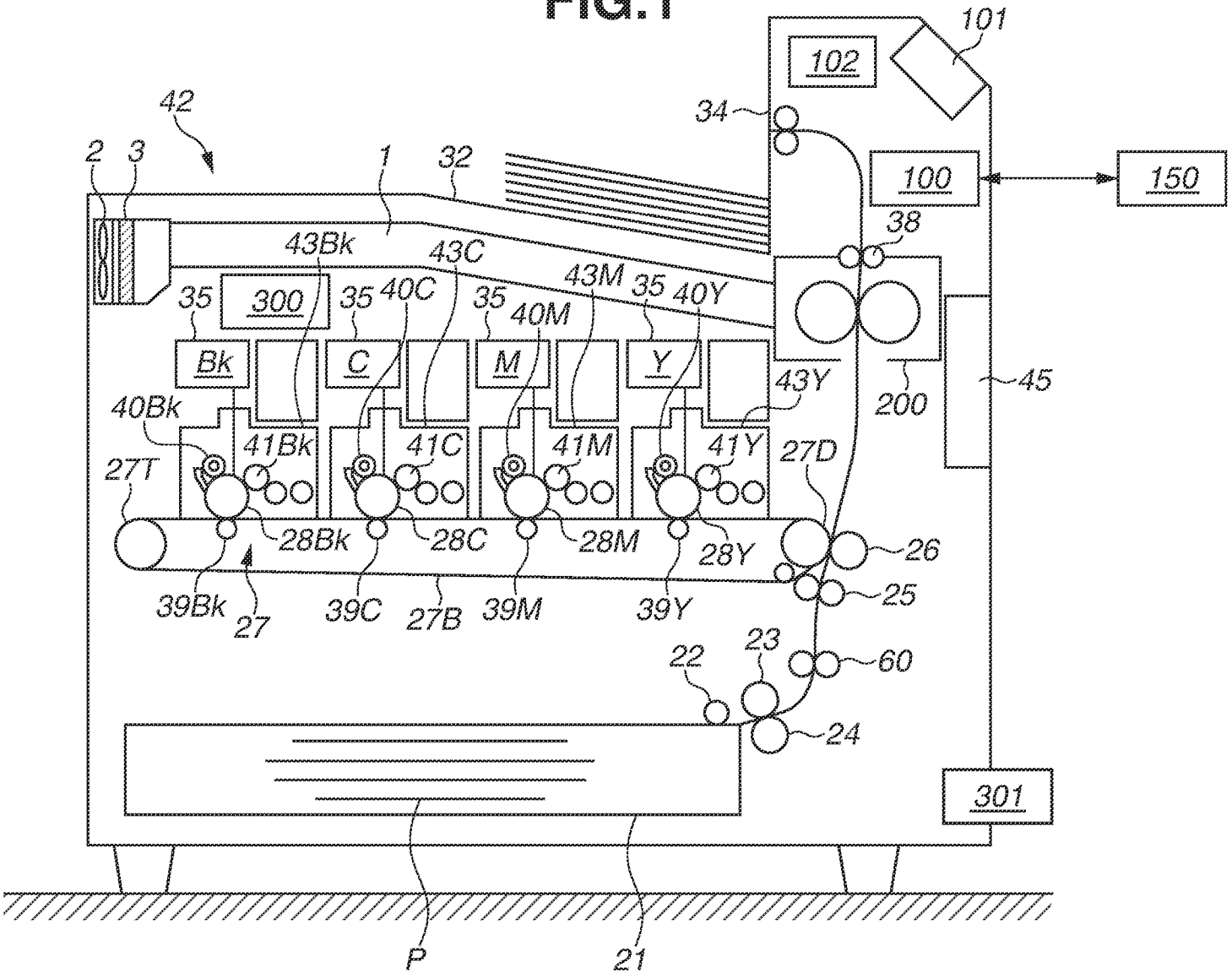
FIG. 1 is a cross-section diagram illustrating a configuration of an image forming apparatus.

First, with reference to a cross-section diagram illustrated in FIG. 1, the configuration of an image forming apparatus according to the first exemplary embodiment of the present disclosure is described.

An image forming apparatus 42 includes a feed cassette 21, a pickup roller 22, a feed roller 23, a retard roller 24, a conveyance roller pair 60, a registration roller pair 25, a secondary transfer roller 26, an intermediate transfer unit 27, a driving roller 27D, and a tension roller 27T. Further, the image forming apparatus 42 includes a discharge roller pair 34 and a discharge tray 32 in its upper portion.

Further, the image forming apparatus 42 includes an intermediate transfer belt 27B, which is an endless belt, as the intermediate transfer unit 27. The driving roller 27D and the tension roller 27T stretch the intermediate transfer belt 27B therearound. The driving roller 27D abuts the secondary transfer roller 26 through the intermediate transfer belt 27B.

The image forming apparatus 42 includes an image forming unit 43Bk for black (Bk), an image forming unit 43C for cyan (C), an image forming unit 43M for magenta (M), and an image forming unit 43Y for yellow (Y).

The image forming units 43Bk, 43C, 43M, and 43Y include rotatable photosensitive drums 28Bk, 28C, 28M, and 28Y, respectively, as image bearing members. Each of the photosensitive drums 28Bk, 28C, 28M, and 28Y is provided so as to be attachable to and detachable from the image forming apparatus 42 by opening a door (front door) provided on the front surface of the image forming apparatus 42.

Further, the image forming units 43Bk, 43C, 43M, and 43Y include charging rollers 40Bk, 40C, 40M, and 40Y as charging units for charging the surfaces of the photosensitive drums 28Bk, 28C, 28M, and 28Y, respectively.

Further, the image forming units 43Bk, 43C, 43M, and 43Y include developing devices 41Bk, 41C, 41M, and 41Y as developing units for developing electrostatic latent images formed on the surfaces of the photosensitive drums 28Bk, 28C, 28M, and 28Y, respectively, using developer containing toner and carrier. The developing device 41Bk stores developer for black containing black toner and carrier. The developing device 41C stores developer for cyan containing cyan toner and carrier. The developing device 41M stores developer for magenta containing magenta toner and carrier. The developing device 41Y stores developer for yellow containing yellow toner and carrier.

Further, the image forming units 43Bk, 43C, 43M, and 43Y include primary transfer rollers 39Bk, 39C, 39M, and 39Y, respectively, as primary transfer units. Each of the primary transfer rollers 39Bk, 39C, 39M, and 39Y is pressurized to the intermediate transfer belt 27B side by a spring.

In the image forming units 43Bk, 43C, 43M, and 43Y, the charging rollers 40Bk, 40C, 40M, and 40Y, the developing devices 41Bk, 41C, 41M, and 41Y, and the primary transfer rollers 39Bk, 39C, 39M, and 39Y are disposed along the rotational directions of the photosensitive drums 28Bk, 28C, 28M, and 28Y, respectively.

Further, the image forming apparatus 42 includes laser scanners 35 as exposure units for exposing the surfaces of the photosensitive drums 28Bk, 28C, 28M, and 28Y.

Further, the image forming apparatus 42 includes a fixing device 200 as an image heating device for heating a toner image (unfixed toner image) transferred onto a recording material P to fix the toner image to the recording material P. The fixing device 200 functions as a fixing unit for fixing the unfixed toner image to the recording material P by pressurizing and heating the recording material P bearing the unfixed toner image. The fixing device 200 is provided so as to be attachable to and detachable from the image forming apparatus 42 by opening the door 45 provided on the side surface of the image forming apparatus 42.

Further, based on image information input from an external host apparatus 150 such as a computer (PC) or an image reader, the image forming apparatus 42 executes an image formation operation, thereby forming an image on the recording material P. Then, the image forming apparatus 42 outputs the recording material P. The external host apparatus 150 is connected to a read-only memory (ROM) 100 as a storage device of a control circuit unit (a control board as a controller: central processing unit (CPU) 102) so as to be configured to communicate with the ROM 100. The control circuit unit including the ROM 100 transmits and receives a signal to and from the external host apparatus 150. Further, the control circuit unit including the ROM 100 also transmits and receives signals to and from various image formation apparatuses, thereby controlling an image formation sequence.

Next, a description is given of a series of operations performed when the image forming apparatus 42 executes an image forming operation (also referred to as "printing"). In a case where the image forming apparatus 42 executes the image forming operation, first, several recording materials P stored in the feed cassette 21 are conveyed by the pickup roller 22. At this time, the several recording materials P conveyed from the feed cassette 21 are separated one by one by the feed roller 23 and the retard roller 24. Then, each recording material P is conveyed to the registration roller pair 25 by the conveyance roller pair 60. Then, the recording material P conveyed to the registration roller pair 25 temporarily stops here.

To form predetermined electric charges on the surfaces of the photosensitive drums 28Bk, 28C, 28M, and 28Y, the image forming apparatus 42 applies a voltage of about 4 to 5 kV to each of the charging rollers 40Bk, 40C, 40M, and 40Y. Then, the charging rollers 40Bk, 40C, 40M, and 40Y are urged to the surfaces of the photosensitive drums 28Bk, 28C, 28M, and 28Y, respectively, by predetermined pressure, thereby performing electric discharge.

Next, the laser scanners 35 expose the surfaces of the photosensitive drums 28Bk, 28C, 28M, and 28Y on which the predetermined electric charges are formed. Consequently, electrostatic latent images are formed on the surfaces of the photosensitive drums 28Bk, 28C, 28M, and 28Y. The electrostatic latent images formed on the surfaces of the photosensitive drums 28Bk, 28C, 28M, and 28Y are developed by the developing devices 41Bk, 41C, 41M, and 41Y, respectively, supplying the toner in the developer. Then, the toner images formed on the surfaces of the photosensitive drums 28Bk, 28C, 28M, and 28Y are primarily transferred onto the intermediate transfer belt 27B. Along with the rotation of the intermediate transfer belt 27B, the toner image primarily transferred onto the intermediate transfer belt 27B proceeds to the position where the intermediate transfer belt 27B and the secondary transfer roller 26 are opposed to each other. Then, in synchronization with the toner image having proceeded to the position where the intermediate transfer belt 27B and the secondary transfer roller 26 are opposed to each other, the image forming apparatus 42 conveys again the recording material P having temporarily stopped at the registration roller pair 25. The toner image is transferred by the secondary transfer roller 26 onto the recording material P conveyed again. Then, the recording material P bearing the unfixed toner image is heated and pressurized by the fixing device 200, thereby fixing the unfixed toner image to the recording material P. The recording material P to which the toner image is fixed passes through the conveyance roller pair 38 disposed downstream of the fixing device 200 in the conveyance direction of the recording material P and is then discharged onto the discharge tray 32 by the discharge roller pair 34.

The image forming apparatus 42 includes a thermistor 300 as a detection unit for detecting the ambient temperature in space inside the image forming apparatus 42 (hereinafter referred to as "inside the apparatus"). The detection unit for detecting the ambient temperature inside the apparatus may be a temperature and humidity sensor for measuring the ambient temperature inside the apparatus and the humidity inside the apparatus.

Further, the image forming apparatus 42 includes a thermistor 301 as a detection unit for detecting the ambient temperature in space outside the image forming apparatus 42 (i.e., the outside air around the image forming apparatus 42, hereinafter referred to as "outside the apparatus"). The detection unit for detecting the ambient temperature outside the apparatus may be a temperature and humidity sensor for measuring the ambient temperature outside the apparatus and the humidity outside the apparatus.

Based on the ambient temperature inside the apparatus detected by the thermistor 300 and the ambient temperature outside the apparatus detected by the thermistor 301, the CPU 102 of the image forming apparatus 42 performs various types of control relating to the operations of the developing devices 41Bk, 41C, 41M, and 41Y and the fixing device 200.

Further, an operation unit as a user interface (UI) configured to receive various operations from a user of the image forming apparatus 42 is provided on the front surface of the image forming apparatus 42. In at least a part of the operation unit, a display unit 101 (e.g., liquid crystal panel) is provided. The CPU 102 controls the display unit 101 so as to display predetermined information on the display unit 101, and thereby notifying the user of the image forming apparatus 42 of the predetermined information to urge the user to perform an operation based on the predetermined information.

<Configurations of Exhaust Air Duct and Air Exhaust Fan>

Figure 2:
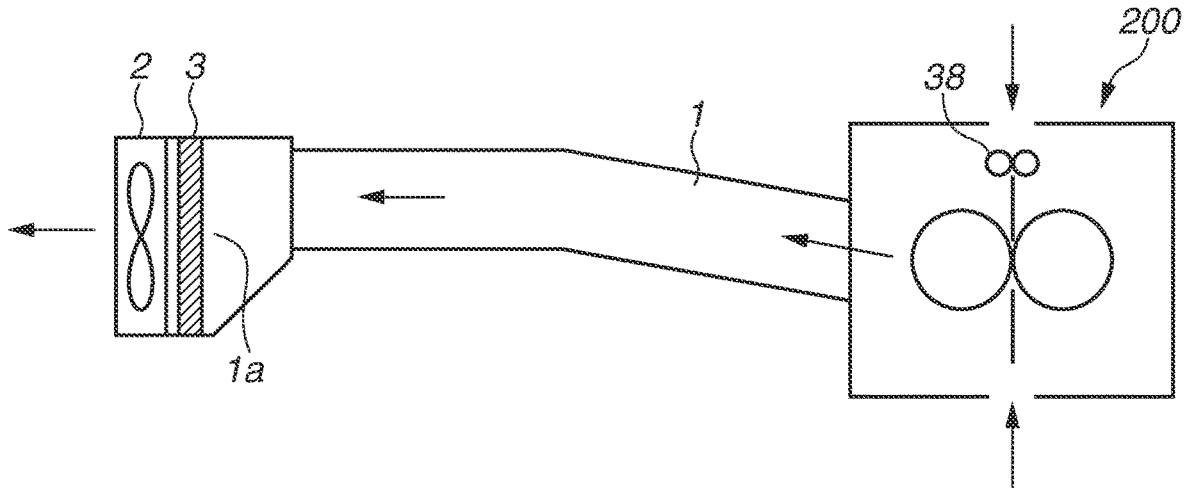
FIG. 2 is a cross-section diagram illustrating a configuration of an air exhaust fan.

Next, with reference to a cross-section diagram in FIG. 2, the configurations of an exhaust air duct and an air exhaust fan are described.

Air inside the apparatus is warmed by heat from the fixing device 200 that rises in temperature with the operation of the image forming apparatus 42, and the ambient temperature inside the apparatus rises. Then, as the extent of the rise in the ambient temperature inside the apparatus becomes greater, the developing devices 41Bk, 41C, 41M, and 41Y are warmed more. Then, the temperature of the developer stored in each of the warmed developing devices 41Bk, 41C, 41M, and 41Y becomes high. Generally, developer is weak against heat. Thus, when heat continues to be applied to the developer, the toner in the developer clumps, and the fluidity of the developer becomes low. If the fluidity of the developer becomes low, the quality characteristics of the developer decrease. This may deteriorate image quality.

Accordingly, to reduce the extent of the rise in the ambient temperature inside the apparatus, for example, the discharge of the warmed air inside the apparatus to outside the apparatus is considered. More specifically, as illustrated in FIG. 2, an exhaust air duct 1 (e.g., fixing exhaust heat duct) including a discharge opening 1*a* for discharging warmed air inside the apparatus (e.g., air around the fixing device 200 warmed by heat generated from the fixing device 200) to outside the apparatus is provided inside the apparatus. Further, while the exhaust air duct 1 is provided inside the apparatus, an air exhaust fan 2 for exhausting the warmed air inside the apparatus is connected to the exhaust air duct 1. Then, the air exhaust fan 2 is caused to operate by driving the air exhaust fan 2 at a predetermined voltage during the operation of the image forming apparatus 42. Thus, the warmed air inside the apparatus is exhausted via the discharge opening 1*a* of the exhaust air duct 1 using the air exhaust fan 2. This reduces the extent of the rise in the ambient temperature inside the apparatus.

Meanwhile, floating substances such as paper dust and toner (e.g., dust generated in the fixing device 200) exist inside the apparatus. Thus, when the warmed air inside the apparatus is exhausted via the discharge opening 1*a* of the exhaust air duct 1 using the air exhaust fan 2, it is necessary or at least appropriate to prevent these floating substances from being discharged to outside the apparatus via the discharge opening 1*a* of the exhaust air duct 1. Accordingly, a filter 3 for collecting (capturing) floating substances is provided between the discharge opening 1*a* of the exhaust air duct 1 and the air exhaust fan 2 to collect floating substances that are to pass through the filter 3.

With reference to FIG. 2, a specific description is given. Heat inside the fixing device 200 and dust generated in the fixing device 200 are discharged to outside the image forming apparatus 42 by the flow of air in the direction of arrows in FIG. 2 formed by the air exhaust fan 2. Then, the filter 3 provided in the middle of the exhaust air duct 1 collects the dust generated in the fixing device 200. Further, the heat inside the fixing device 200 is transferred as a convection flow to outside the image forming apparatus 42 through the filter 3. In this way, heat accumulated in a component included in the fixing device 200 and the heat of the recording material P passing through the fixing device 200 move to the space outside the image forming apparatus 42.

In the example of FIG. 2, the fixing device 200 and the exhaust air duct 1 are connected. In addition to the vicinity of the fixing device 200, the following places are also assumed as places where the effect of heat exhaust is checked. For example, in the vicinity of a motor for rotationally driving each of the photosensitive drums 28Bk, 28C, 28M, and 28Y, heat is generated by the rotational driving of the motor. Accordingly, to reduce the extent of the rise in the temperature around each of the photosensitive drums 28Bk, 28C, 28M, and 28Y, the exhaust air duct 1 may be connected in the vicinity of the motor for rotationally driving each of the photosensitive drums 28Bk, 28C, 28M, and 28Y. Further, for example, in the vicinity of a motor for rotationally driving a screw for conveying and agitating the developer stored in each of the developing devices 41Bk, 41C, 41M, and 41Y, heat is generated by the rotational driving of the motor. Thus, to reduce the extent of the rise in the temperature around each of the developing devices 41Bk, 41C, 41M, and 41Y, the exhaust air duct 1 may be connected in the vicinity of the motor for rotationally driving the screw for conveying and agitating the developer stored in each of the developing devices 41Bk, 41C, 41M, and 41Y.

These effects of heat exhaust are exerted, whereby it is possible to prevent the extent of the rise in the ambient temperature inside the apparatus from becoming great. As a result, it is possible to prevent the temperatures of the developer stored in the developing devices 41Bk, 41C, 41M, and 41Y from becoming high due to the warming of the developing devices 41Bk, 41C, 41M, and 41Y.

<Configuration of Filter>

Figure 3:
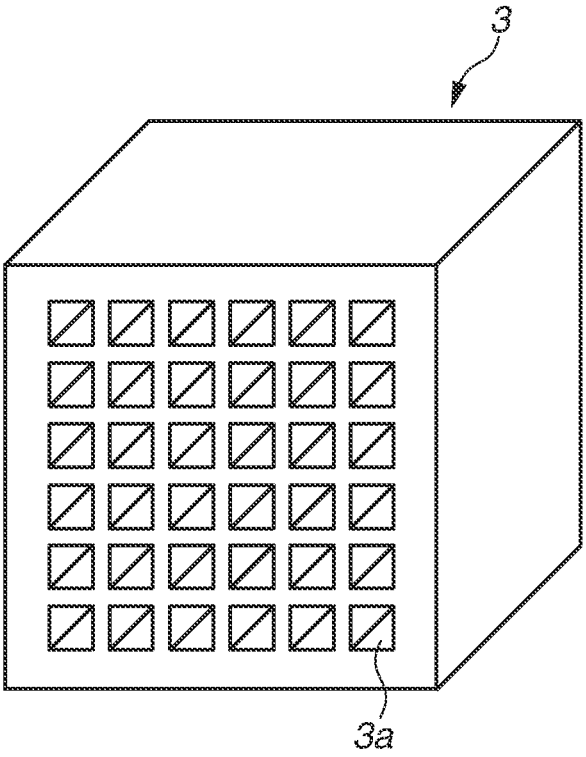
FIG. 3 is a perspective view illustrating a configuration of a filter.

Next, with reference to a perspective view in FIG. 3, the configuration of the filter 3 is described.

FIG. 3 illustrates a honeycomb filter as an example of the filter 3. The honeycomb filter is composed of honeycomb carbon containing granular activated carbon. In the honeycomb filter (the filter 3), a plurality of filter pores 3*a* is provided. Air passing through the honeycomb filter (the filter 3) comes into contact with the granular activated carbon inside the filter 3 when passing through the filter pores 3*a*. At this time, dust carried from the fixing device 200 through the exhaust air duct 1 is collected by the granular activated carbon contained in the honeycomb filter (the filter 3). In this way, air (clean air) obtained after collecting floating substances is discharged to outside the image forming apparatus 42.

However, when passing through the filter pores 3*a* of the honeycomb filter (the filter 3), the air encounters resistance from the filter pores 3*a*. Thus, a pressure drop occurs. Particularly, as the proportion of the operating time of the image forming apparatus 42 to the life of the main body of the image forming apparatus 42 increases, the amount of floating substances, such as toner and paper dust generated inside the image forming apparatus 42, attached to the filter pores 3*a* increases on the wall surfaces of the filter pores 3*a*. Then, there is a tendency that as the amount of floating substances attached to the filter pores 3*a* increases, the pressure drop increases. As a result, the wind velocity and the airflow volume of air passing through the filter 3 may decrease, and warmed air inside the apparatus may be less likely to be discharged to outside the apparatus. Thus, the temperature inside the apparatus may rise more than expected.

As described above, as the extent of the rise in the ambient temperature inside the apparatus increases, the developing devices 41Bk, 41C, 41M, and 41Y are wormed more. As a result, the temperatures of the developer stored in the warmed developing devices 41Bk, 41C, 41M, and 41Y become high. Generally, a developer is weak against heat. Thus, when heat continues to be applied to the developer, toner in the developer clumps, and the fluidity of the developer becomes low. If the fluidity of the developer becomes low, the quality characteristics of the developer decrease. This may deteriorate image quality.

To repeat the description, as the amount of floating substances collected by the filter 3 increases, the extent of the progress of the clogging of the filter 3 increases. Thus, air is less likely to pass through the filter 3. As a result, even if an attempt is made to exhaust the warmed air inside the apparatus via the discharge opening 1*a* of the exhaust air duct 1 using the air exhaust fan 2, the warmed air inside the apparatus cannot pass through the filter 3 and tends to stagnate on the near side of the filter 3. This means that the efficiency of exhausting warmed air inside the apparatus through the discharge opening 1*a* of the exhaust air duct 1 using the air exhaust fan 2 decreases. As a result, the efficiency of suppressing the rise in the ambient temperature inside the apparatus decreases. Thus, in a case where the extent of the progress of the clogging of the filter 3 is great, it is necessary or at least appropriate to replace the filter 3 at an appropriate timing.

Figure 4A:
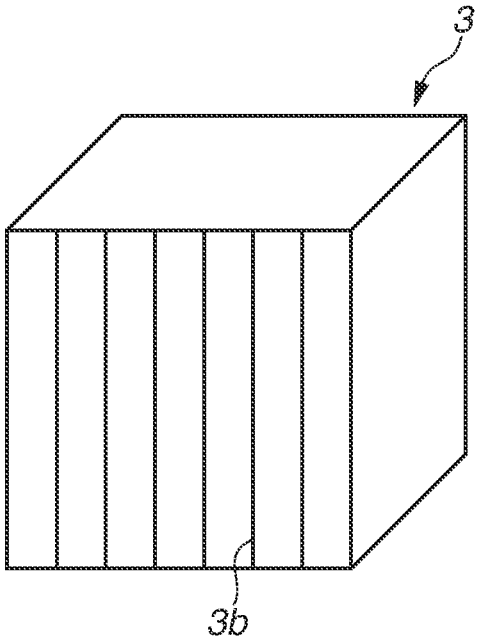
FIGS. 4A and 4B are a perspective view and a cross-section diagram illustrating another configuration of the filter.
Figure 4B:
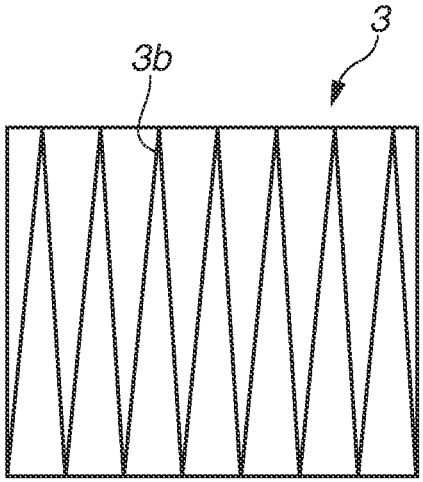

Next, with reference to a perspective view in FIG. 4A and a cross-section diagram in FIG. 4B, another example of the configuration of the filter 3 is described. FIG. 4A illustrates a perspective view of a pleated filter as another example of the configuration of the filter 3. FIG. 4B illustrates a cross-section diagram of the pleated filter as another example of the configuration of the filter 3. In the pleated filter as an example of the filter 3, polyester non-woven fabric 3*b* containing granular activated carbon is arranged in a folded-up manner as illustrated in FIG. 4B. Thus, the pleated filter has a wide contact region with air and therefore has an excellent ability to collect dust and toner. Meanwhile, when air passes through the pleated filter, a large pressure drop occurs.

<Method for Measuring Airflow Volume of Air Passing Through Filter>

Figure 5:
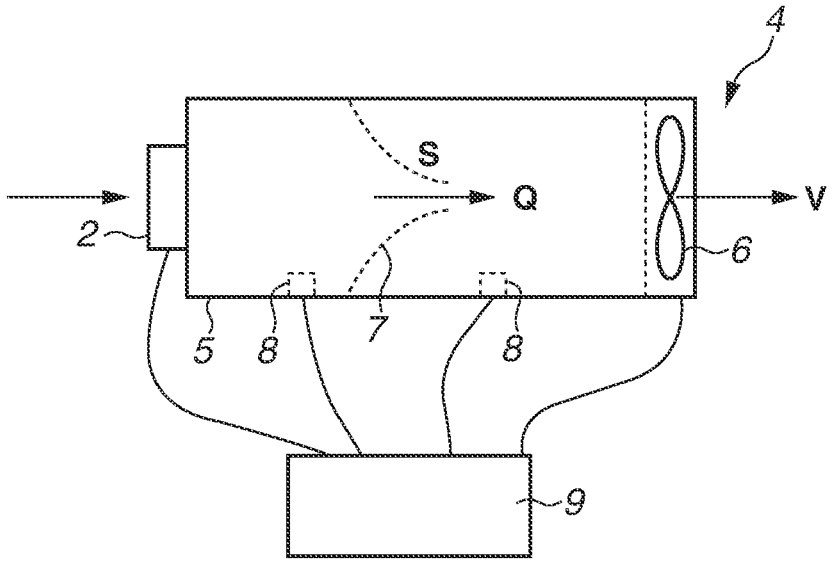
FIG. 5 is a cross-section diagram illustrating a configuration of a device for measuring resistance when air passes through an exhaust air duct.

Next, with reference to a cross-section diagram in FIG. 5, a description is given of the characteristics of the air exhaust fan 2 and the configuration of a measurement device for measuring resistance when air passes through the exhaust air duct 1.

In the first exemplary embodiment, to measure the airflow volume of air passing through the filter 3, a measurement device 4 illustrated in FIG. 5 measures the characteristics of the air exhaust fan 2 and resistance when air passes through the exhaust air duct 1. In the measurement device 4, a booster fan 6 is disposed at a rear portion of a duct 5, and a valve 7 configure to change the size of an opening cross-sectional area S is disposed in the middle of the duct 5. The measurement device 4 measures an airflow volume Q of air flowing through the duct 5 and differential pressure using a differential pressure gauge 8. The airflow volume Q of air flowing through the duct 5 is calculated as the product of a wind velocity V of the booster fan 6 and the opening cross-sectional area S of the valve 7 ($Q=V\times S$).

<Airflow Volume of Air Passing Through Filter and Shift in Ambient Temperature Inside Apparatus>

Figure 6A:
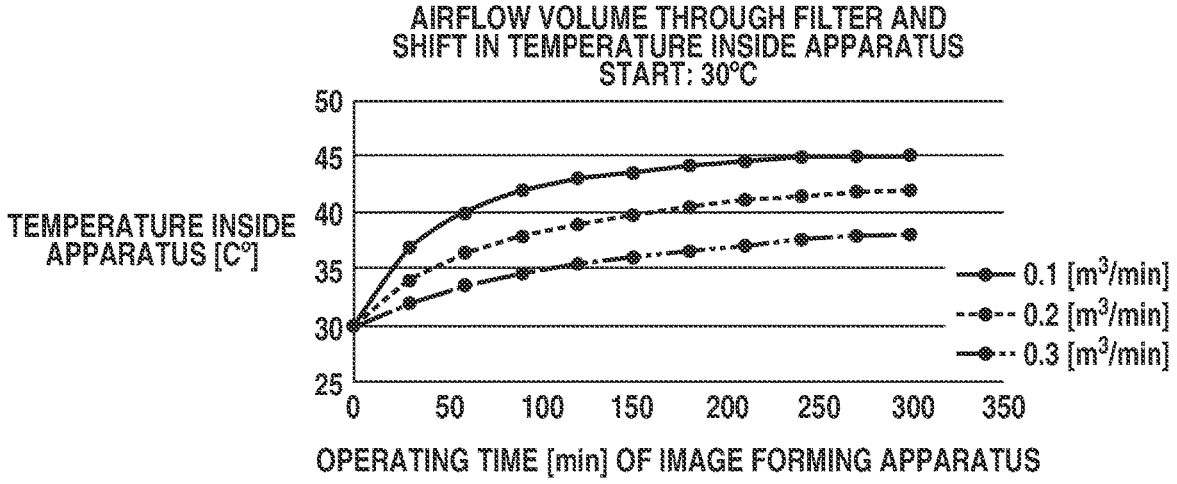
FIGS. 6A, 6B, and 6C are graphs each illustrating a shift in ambient temperature inside the apparatus according to a first exemplary embodiment.
Figure 6B:
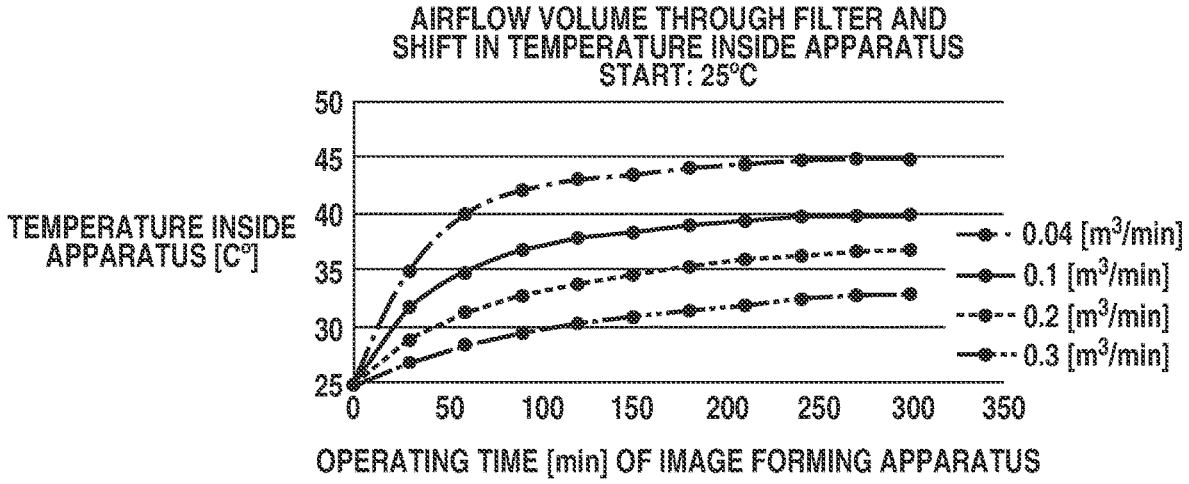
Figure 6C:
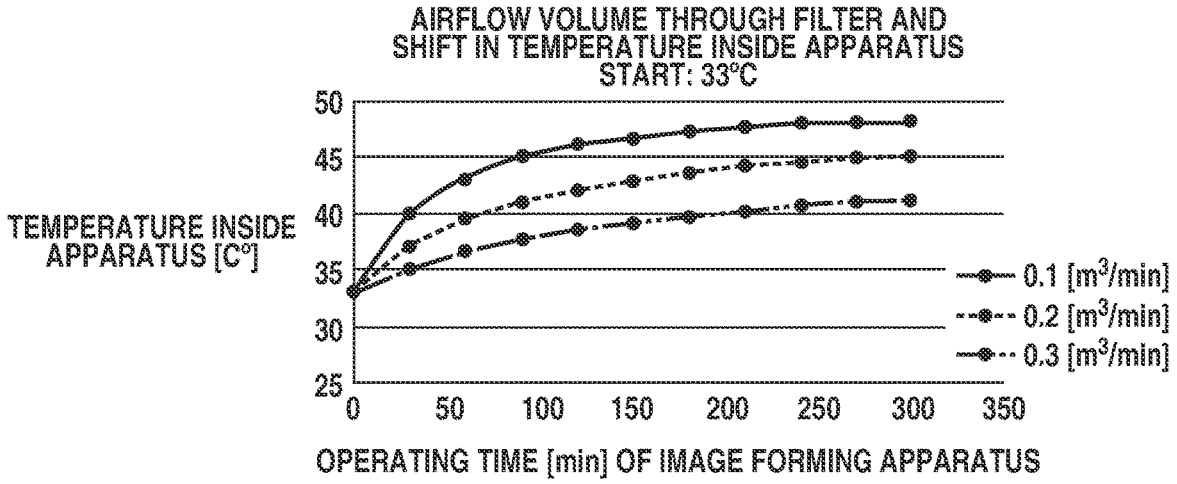

In the first exemplary embodiment, the airflow volume Q of air flowing through the duct 5 is measured in advance by the method for measuring the airflow volume of air passing through the filter 3 described above with reference to FIG. 5. In the first exemplary embodiment, as the filter 3 for which the airflow volume Q of air flowing through the duct 5 is measured in advance, three types of filters for airflow volumes of 0.3 $m^3$/min, 0.2 $m^3$/min, and 0.1 $m^3$/min are prepared. With reference to FIGS. 6A to 6C, a description is given of a graph of the shift in the ambient temperature inside the apparatus when each of the three types of filters 3 is attached to the image forming apparatus 42, and the image forming apparatus 42 continues to operate.

In the example of FIG. 6A, each of the ambient temperature outside the apparatus and the ambient temperature inside the apparatus when the operation of the image forming apparatus 42 starts (also referred to as a "start time") is 30° C. At this time, "the ambient temperature outside the apparatus" refers to the temperature around the image forming apparatus 42 measured by the thermistor 301 and is equivalent to the temperature of the outside air. Although depending on the properties of the toners as materials, if the ambient temperature inside the apparatus exceeds 45° C. in the image forming apparatus 42, the toner in the developer starts to clump. This may cause an image defect such as a stained image or a streak image on the recording material P, or the firm fixing of toner. In the first exemplary embodiment, the description is given on the assumption that the ambient temperature inside the apparatus reaches 45° C. as the saturation temperature. Alternatively, this threshold may be changed based on the meltability of the toner or consideration results.

As illustrated in FIG. 6A, if the airflow volume of air passing through the filter 3 is 0.1 $m^3$/min, and the image forming apparatus 42 continues to operate, the ambient temperature inside the apparatus becomes saturated at 45° C. Therefore, the time when the airflow volume of air passing through the filter 3 becomes less than 0.1 $m^3$/min is the timing when the image forming apparatus 42 determines that the filter 3 is clogged. This is because each of the temperature at which the ambient temperature inside the apparatus becomes saturated and the speed at which the ambient temperature inside the apparatus rises depends substantially on the temperature of the outside air and the airflow volume of air passing through the filter 3. In other words, each of the temperature at which the ambient temperature inside the apparatus becomes saturated and the speed at which the ambient temperature inside the apparatus rises depends substantially on the ambient temperature outside the apparatus when the operation of the image forming apparatus 42 starts, and the extent of the progress of the clogging of the filter 3.

In the example of FIG. 6B, each of the ambient temperature outside the apparatus and the ambient temperature inside the apparatus when the operation of the image forming apparatus 42 starts is 25° C. On the other hand, in the example of FIG. 6C, each of the ambient temperature outside the apparatus and the ambient temperature inside the apparatus when the operation of the image forming apparatus 42 starts is 33° C.

As illustrated in FIG. 6B, when the ambient temperature outside the apparatus is 25° C., and if the airflow volume of air passing through the filter 3 is 0.1 $m^3$/min, and the image forming apparatus 42 continues to operate, the ambient temperature inside the apparatus becomes saturated at about 40° C. Further, as illustrated in FIG. 6B, when the ambient temperature outside the apparatus is 25° C., and if the airflow volume of air passing through the filter 3 is 0.04 $m^3$/min, and the image forming apparatus 42 continues to operate, the ambient temperature inside the apparatus becomes saturated at 45° C.

As described above, a plurality of pieces of information regarding the temperature of the outside air (ambient temperature outside the apparatus when the operation of the image forming apparatus 42 starts) and the rising curve of the ambient temperature inside the apparatus based on the airflow volume of air passing through the filter 3 is recorded in advance in the ROM 100. Then, there is a case where, when the temperature of the outside air is a predetermined temperature, the extent of the actual rise in the ambient temperature inside the apparatus is greater than the shift in the ambient temperature inside the apparatus that becomes saturated at 45° C. Such a case means that the efficiency of exhausting warmed air inside the apparatus through the discharge opening 1*a* of the exhaust air duct 1 using the air exhaust fan 2 decreases. This corresponds to a decrease in the efficiency of suppressing the rise in the ambient temperature inside the apparatus. Thus, it can be said that the extent of the progress of the clogging of the filter 3 has a tendency to be actually great. Thus, it is necessary or at least appropriate to replace the filter 3 at an appropriate timing.

In this case, the CPU 102 controls the display unit 101 so as to display information regarding the replacement of the filter 3 on the display unit 101. More specifically, the control includes a method for transmitting, as the information regarding the replacement of the filter 3, a message (warning) for urging the user to replace the filter 3, using characters, a sound, or a lamp or using these in combination. Examples of the message (the warning) for urging the user to replace the filter 3 include "Time is coming to replace filter. Please replace filter". In this way, it is possible to notify the user of the image forming apparatus 42 (or a serviceman or technician) that the time comes to replace the filter 3.

As described above, if the extent of the progress of the clogging of the filter 3 is great, it is necessary or at least appropriate to replace the filter 3 at an appropriate timing. Meanwhile, in the first exemplary embodiment, a plurality of pieces of information regarding the temperature of the outside air (ambient temperature outside the apparatus when the operation of the image forming apparatus 42 starts) and the rising curve of the ambient temperature inside the apparatus corresponding to the airflow volume of air passing through the filter 3 is recorded in advance in the ROM 100. In this way, it is possible to display information regarding the replacement of the filter 3 on the display unit 101 at an appropriate timing depending on the temperature of the outside air (ambient temperature outside the apparatus when the operation of the image forming apparatus 42 starts). After confirming that a message (warning) for urging the user to replace the filter 3 is displayed on the display unit 101, the user of the image forming apparatus 42 may only need to replace the filter 3. In this way, it is possible to replace the filter 3 at an appropriate timing while effectively using the filter 3 until the filter 3 reaches the end of its life. In other words, even if the extent of the progress of the clogging of the filter 3 actually becomes great, the filter 3 is replaced before the ambient temperature inside the apparatus reaches 45° C. As a result, it is possible to prevent deterioration in image quality caused by the toner in the developer clumping as a result of the rise in the ambient temperature inside the apparatus to 45° C. or above due to the fact that the extent of the progress of the clogging of the filter 3 is great.

In a case where the user attempts to continue the image forming operation without replacing the filter 3 even though the information regarding the replacement of the filter 3 is displayed on the display unit 101, the CPU 102 may interrupt the image forming operation with the following control. That is, based on the fact that the ambient temperature inside the apparatus reaches 45° C. in the state where the filter 3 is not replaced even though the information regarding the replacement of the filter 3 is displayed on the display unit 101, the CPU 102 may forcibly control the image forming operation to be suspended.

<Example of Control According to First Exemplary Embodiment>

Figure 7:
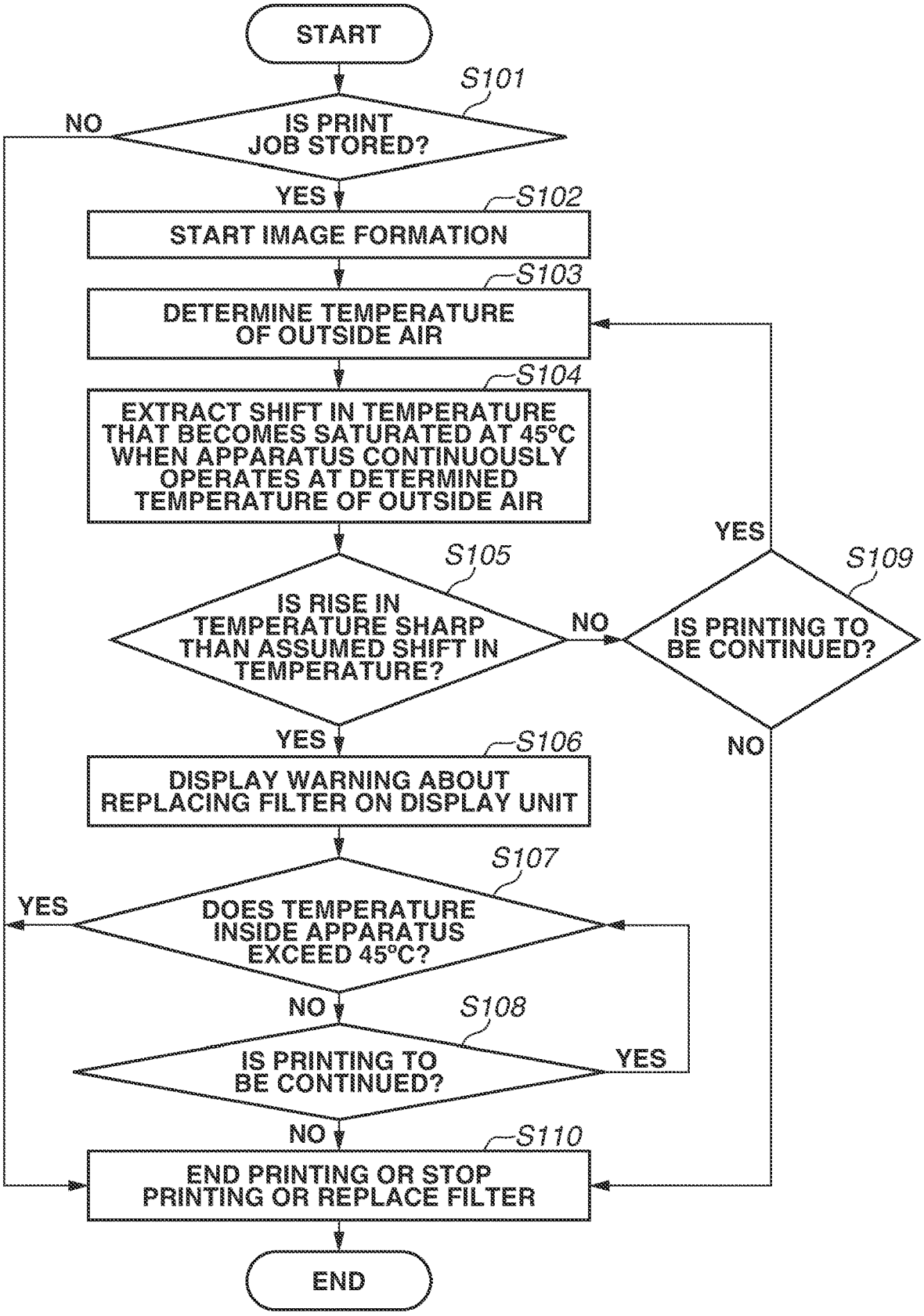
FIG. 7 is a flowchart illustrating an example of control according to the first exemplary embodiment.

With reference to a flowchart illustrated in FIG. 7, an example of control according to the first exemplary embodiment is described. This processing is performed by the CPU 102 executing a control program read from the ROM 100 (i.e., a control program read from the ROM 100 and loaded into a random-access memory (RAM) included in the image forming apparatus 42).

First, in step S101, the CPU 102 checks whether a job (hereinafter referred to as a "print job") for forming an image using the image forming units 43Bk, 43C, 43M, and 43Y is stored in a print queue (i.e., the presence or absence of a print job). If a print job is not stored (NO in step S101), the processing proceeds to step S110. In step S110, the CPU 102 ends the image forming operation. On the other hand, if the print job is stored (Yes in step S101), the processing proceeds to step S102. In step S102, the CPU 102 starts the image forming operation.

In step S103, the CPU 102 acquires the temperature of the outside air measured by the thermistor 301, thereby determining the temperature of the outside air (the ambient temperature outside the apparatus when the operation of the image forming apparatus 42 starts). Then, in step S104, the CPU 102 reads "data of the shift in the ambient temperature inside the apparatus when the ambient temperature inside the apparatus becomes saturated at 45° C. in a case where the image forming apparatus 42 continues to operate at the temperature of the outside air determined in step S103" from the ROM 100. As described above, in the first exemplary embodiment, a plurality of pieces of information regarding the temperature of the outside air (the ambient temperature outside the apparatus when the operation of the image forming apparatus 42 starts) and the rising curve of the ambient temperature inside the apparatus according to the airflow volume of air passing through the filter 3 is recorded in advance in the ROM 100.

Then, after the image forming operation progresses, the processing proceeds to step S105. In step S105, the CPU 102 compares the shift in the ambient temperature inside the apparatus with the "data of the shift in the ambient temperature inside the apparatus when the ambient temperature inside the apparatus becomes saturated at 45° C. in a case where the image forming apparatus 42 continues to operate at the temperature of the outside air determined in step S103" acquired in step S104. If, as a result of the comparison in step S105, the CPU 102 determines that the extent of the actual rise in the ambient temperature inside the apparatus is greater than the shift in the ambient temperature inside the apparatus that becomes saturated at 45° C. in the case of the temperature of the outside air determined in step S103 (Yes in step S105), the processing proceeds to step S106. In step S106, the CPU 102 displays a message (warning) for urging the user to replace the filter 3 on the display unit 101, and the processing proceeds to step S107. On the other hand, if the CPU 102 determines that the extent of the actual rise in the ambient temperature inside the apparatus is greater than the shift in the ambient temperature inside the apparatus that becomes saturated at 45° C. in the case of the temperature of the outside air determined in step S103 (NO in step S105), the processing proceeds to step S109. In step S109, the CPU 102 determines whether the image forming operation is to be continued. If the image forming operation is to be continued (Yes in step S109), the processing returns to step S103. Then, the CPU 102 performs the processing of step S103 and the subsequent steps again. On the other hand, if the image forming operation is not to be continued (NO in step S109), the processing proceeds to step S110. In step S110, the CPU 102 ends the image forming operation.

In step S107, the CPU 102 checks whether the ambient temperature inside the apparatus measured by the thermistor 300 exceeds 45° C. If it is determined that the ambient temperature inside the apparatus exceeds 45° C. (Yes in step S107), the processing proceeds to step S110. In step S110, the CPU 102 stops the image forming operation. On the other hand, if it is determined that the ambient temperature inside the apparatus does not exceed 45° C. (NO in step S107), the processing proceeds to step S108. In step S108, the CPU 102 checks whether the image forming operation is to be continued. So long as the image forming operation is to be continued (Yes in step S108), the CPU 102 repeats the processing of step S107 in the state where the message (warning) for urging the user to replace the filter 3 is displayed on the display unit 101. On the other hand, if the image forming operation is not to be continued (NO in step S108), the processing proceeds to step S110. In step S110, instead of controlling the image forming units 43 to stop the image forming operation, the CPU 102 may control the display unit 101 so as to display the message for urging the user to replace the filter 3 on the display unit 101. Alternatively, the CPU 102 may perform both control processes.

As described above, in the first exemplary embodiment, a plurality of pieces of information regarding the temperature of the outside air (ambient temperature outside the apparatus when the operation of the image forming apparatus 42 starts) and the rising curve of the ambient temperature inside the apparatus changing corresponding to the airflow volume of air passing through the filter 3 is recorded in advance in the ROM 100. With this configuration, it is possible to display information regarding the replacement of the filter 3 on the display unit 101 at an appropriate timing depending on the temperature of the outside air (ambient temperature outside the apparatus when the operation of the image forming apparatus 42 starts).

Further, as described above, in the first exemplary embodiment, based on the ambient temperature inside the apparatus detected by the thermistor 300 and the ambient temperature outside the apparatus detected by the thermistor 301, the timing for urging the user to replace the filter 3 is controlled. Each of the thermistors 300 and 301 is used in a general-purpose manner in the image forming apparatus 42 so that the CPU 102 performs various types of control related to the operations of the developing devices 41Bk, 41C, 41M, and 41Y and the fixing device 200. Accordingly, it is not necessary to separately provide another sensor to perform the control according to the first exemplary embodiment, and it is not necessary to secure space to provide such a sensor inside the apparatus. This does not result in making the apparatus large.

Thus, according to the first exemplary embodiment, it is possible to prevent an apparatus from becoming large, and with a simple configuration, also urge a user to replace a filter at an appropriate timing, while taking into account whether the extent of the progress of the clogging of the filter has a tendency to be actually great.

As described above, so long as a cooling system cools a portion having heat around the fixing device 200 as with the air exhaust fan 2, a duct connected to a device other than the fixing device 200 and inside the apparatus and a fan disposed around a device other than the fixing device 200 and inside the apparatus may be used. For example, inside each developing device 41, heat transfer from another heat source inside the image forming apparatus 42 or self-heating of a component inside the developing device 41 is generated. This may cause an image defect due to the firm fixing of toner to a component caused by the melting of the toner, or the rise in the temperature of transfer paper. Thus, the first exemplary embodiment can be applied to a duct connected to the developing device 41, a fan disposed around the developing device 41, and a filter.

In the first exemplary embodiment, an example has been described in which a plurality of pieces of information regarding the temperature of the outside air (ambient temperature outside the apparatus when the operation of the image forming apparatus 42 starts) and the rising curve of the ambient temperature inside the apparatus changing depending on the airflow volume of air passing through the filter 3 is recorded in advance in the ROM 100. On the other hand, in a second exemplary embodiment, an example is described in which a plurality of pieces of information regarding the temperature of the outside air (ambient temperature outside the apparatus when the operation of the image forming apparatus 42 starts), the airflow volume of air passing through the filter 3, and the rising curve of the ambient temperature inside the apparatus depending on the grammage of the recording material is recorded in advance in the ROM 100.

The configuration of the image forming apparatus 42 according to the second exemplary embodiment is similar to the configuration of the image forming apparatus 42 according to the first exemplary embodiment, and therefore is not described here. In the second exemplary embodiment, to meet high requirements for the types (so-called medium extensibility) of recording materials (also referred to as "media") onto which toner images are to be transferred, a table (i.e., information regarding the rising curve of the ambient temperature inside the apparatus) in a case of thick paper and two-sided sheet supply is separately provided.

In a case where thick paper as a medium is subjected to two-sided sheet supply, more heat is supplied from the fixing device 200 to inside the apparatus than in a case where plain paper as a medium is subjected to one-sided sheet supply. As a result, the rising curve of the ambient temperature inside the apparatus is sharper than usual (i.e., a case where plain paper as a medium is subjected to one-sided sheet supply), and the ambient temperature inside the apparatus becomes saturated at a temperature higher than usual. For example, the grammage of a medium that is usually used is 60 g/m$^2$ to 130 g/m$^2$. On the other hand, if a table regarding the rise in the ambient temperature inside the apparatus in a case of the grammage of a medium that is usually used is applied particularly to a medium having a grammage of 300 g/m$^2$ or more, the timing of the replacement of the filter 3 may come late. As a matter of course, there is a difference in the setting of the fixing temperature of the fixing device 200 depending on the grammage of the medium. However, particularly when two-sided sheet supply is performed, more heat is supplied from the fixing device 200 to inside the apparatus. Accordingly, the rising curve of the ambient temperature inside the apparatus rapidly becomes sharp.

Thus, in the second exemplary embodiment, information (table or graph) regarding the rising curve of the ambient temperature inside the apparatus based on the temperature of the outside air is prepared for each grammage of a medium, and information (table or graph) is appropriately used depending on the grammage of the medium on which printing is to be performed.

Figure 8:
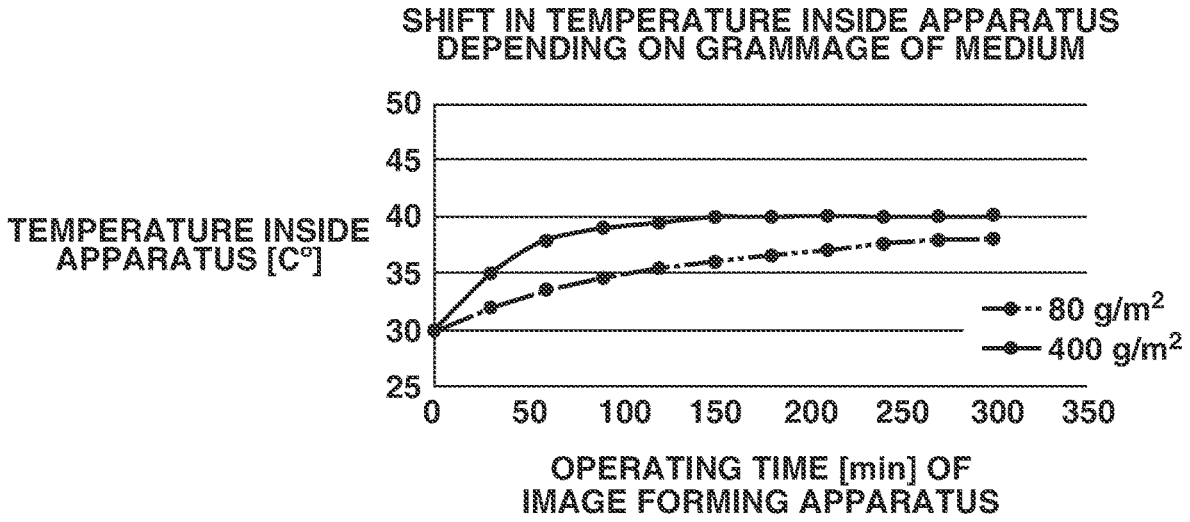
FIG. 8 is a graph illustrating a shift in ambient temperature inside the apparatus according to a second exemplary embodiment.

With reference to FIG. 8, a description is given of a graph of the temperature of the outside air (ambient temperature outside the apparatus when the operation of the image forming apparatus 42 starts) and the shift in the ambient temperature inside the apparatus depending on the grammage of the medium when the image forming apparatus 42 continues to operate.

FIG. 8 illustrates the shift in the ambient temperature inside the apparatus when a medium having a grammage of 60 g/m$^2$ is subjected to two-sided sheet supply, and the shift in the ambient temperature inside the apparatus when a medium having a grammage of 400 g/m$^2$ is subjected to two-sided sheet supply, in a case where the airflow volume of air passing through the filter 3 is a predetermined airflow volume. In the case of the medium having a grammage of 60 g/m$^2$, it takes about 300 minutes for the temperature to become saturated, and the saturation temperature is about 38° C. On the other hand, in the case of the medium having a grammage of 400 g/m$^2$, it takes about 150 minutes for the temperature to become saturated, and the saturation temperature is about 40° C.

Generally, a medium having a grammage of 300 g/m$^2$ or more is remarkably different in saturation time and saturation temperature. Therefore, in the second exemplary embodiment, two tables of a table for a grammage of 300 g/m$^2$ or more and a table for a grammage of less than 300 g/m$^2$, are provided and recorded in advance in the ROM 100. Then, an optimal temperature rising curve is extracted (acquired from the ROM 100) based on the grammage of the medium to be used. With this configuration, if the shift in the rise in the ambient temperature inside the apparatus is greater than the shift in the rise in the ambient temperature inside the apparatus as a comparison target, then similarly to the first exemplary embodiment, a message (warning) for urging the user to replace the filter 3 is displayed on the display unit 101.

<Example of Control According to Second Exemplary Embodiment>

Figure 9:
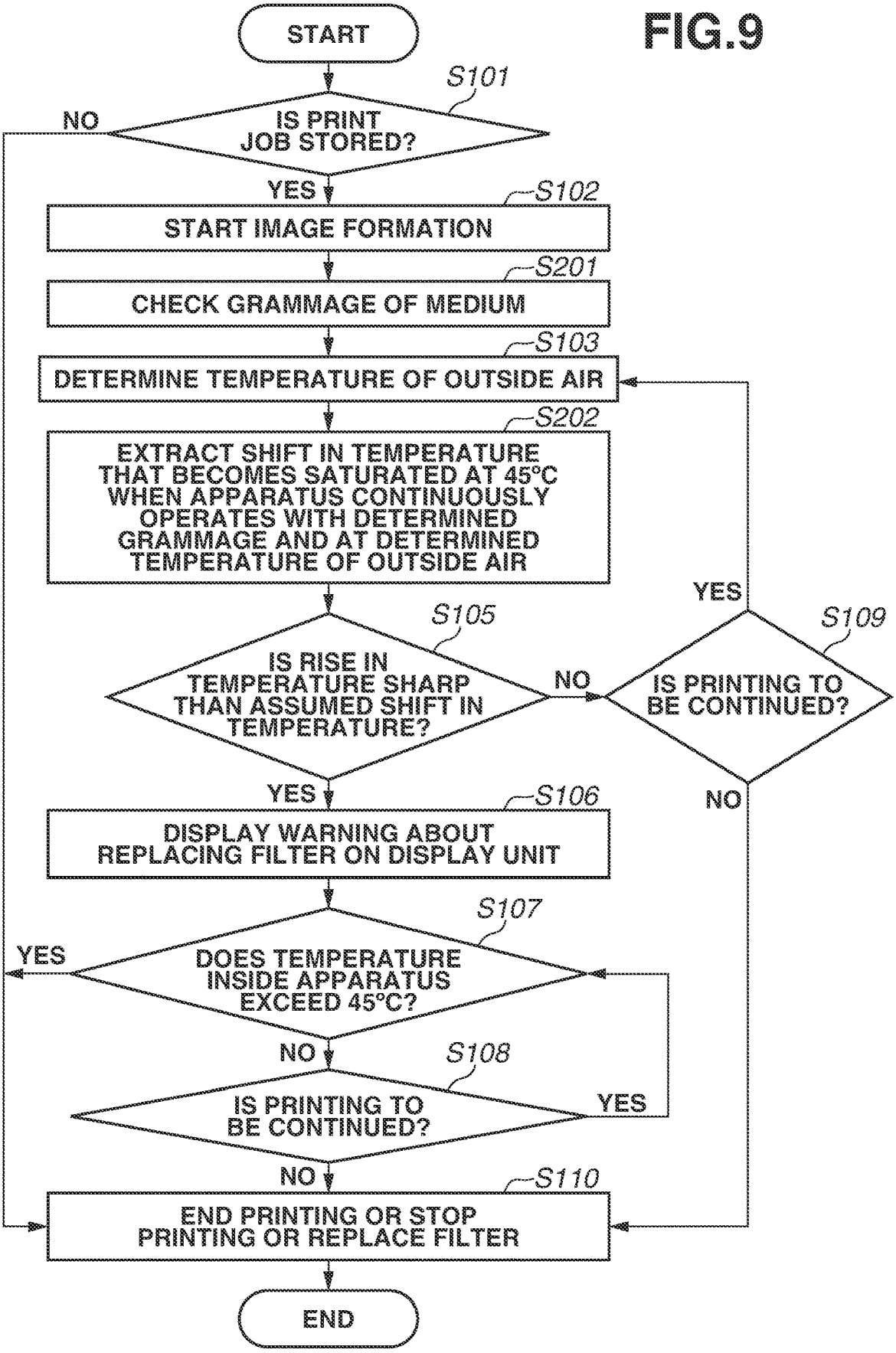
FIG. 9 is a flowchart illustrating an example of control according to the second exemplary embodiment.

With reference to a flowchart illustrated in FIG. 9, an example of control according to the second exemplary embodiment is described. This processing is performed by the CPU 102 executing a control program read from the ROM 100 (control program read from the ROM 100 and loaded into a RAM included in the image forming apparatus 42). In the example of control according to the second exemplary embodiment, processes similar in content to those in the example of control according to the first exemplary embodiment are designated by the same step numbers as those in the first exemplary embodiment (FIG. 7), and are not described in detail here. In the example of control according to the second exemplary embodiment, processes different in content from those in the example of control according to the first exemplary embodiment are mainly described here.

In the second exemplary embodiment, after the image forming operation is started in step S102, the processing proceeds to step S201. In step S201, the CPU 102 checks the grammage of the medium. In step S201, for example, the CPU 102 checks whether the grammage of the medium is 300 g/m$^2$ or more. This is because, as described above, generally, a medium having a grammage of 300 g/m$^2$ or more is remarkably different in saturation time and saturation temperature. After performing the processing of step S201, then in step S103, the CPU 102 acquires the temperature of the outside air measured by the thermistor 301, thereby determining the temperature of the outside air (ambient temperature outside the apparatus when the operation of the image forming apparatus 42 starts). Then, the processing proceeds to step S202.

In step S202, the CPU 102 reads "data of the shift in the ambient temperature inside the apparatus when the ambient temperature inside the apparatus becomes saturated at 45° C. in a case where the image forming apparatus 42 continues to operate with the grammage of the medium determined in step S201 and at the temperature of the outside air determined in step S103" from the ROM 100. As described above, in the second exemplary embodiment, a plurality of pieces of information regarding the temperature of the outside air (ambient temperature outside the apparatus when the operation of the image forming apparatus 42 starts), the airflow volume of air passing through the filter 3, and the rising curve of the ambient temperature inside the apparatus depending on the grammage of the medium is recorded in advance in the ROM 100. After the processing of step S202, the processing proceeds to step S105. The processing of step S105 and the subsequent steps, however, is similar to that in the example of control according to the first exemplary embodiment, and therefore is not described in detail here.

As described above, in the second exemplary embodiment, depending on the grammage of the medium, two types (e.g., a grammage of 300 g/m$^2$ or more and a grammage of less than 300 g/m$^2$) of temperature rising curves of the temperature inside the apparatus that becomes saturated at 45° C. are prepared. With this configuration, even if a medium different in the shift in the rise in the temperature is used, it is possible to display information regarding the replacement of the filter 3 on the display unit 101 at an appropriate timing depending on the temperature of the outside air (ambient temperature outside the apparatus when the operation of the image forming apparatus 42 starts) and the grammage of the medium.

Two types of curves of the shift in the rise in the temperature are used depending on the type of the medium including the grammage of the medium. Alternatively, a variation example may also be employed in which the curves of the shift in the rise in the temperature are further subdivided based on the difference in speed at which the image forming apparatus 42 rises in temperature, and the subdivided curves are stored in advance in the ROM 100. Yet alternatively, the curve of the shift in the rise in the temperature may be subdivided based on, other than the grammage of the medium, whether two-sided sheet supply or one-sided sheet supply is performed, and the subdivided curves may be stored in advance in the ROM 100. Then, a method for, based on the grammage of the medium on which an image is to be formed and further based on whether two-sided sheet supply or one-sided sheet supply is to be performed, extracting (acquiring) the curve of the shift in the rise in the temperature from the ROM 100 and comparing the acquired shift in the rise in the temperature with the actual shift in the rise in the temperature may be applied. Further, in a case where the image forming apparatus 42 has a plurality of process speeds, as the process speed becomes faster, a component (e.g., a motor) included in a device inside the apparatus is more likely to rise in temperature. Thus, the curve of the shift in the rise in the temperature based on the process speed may be employed.

Other Embodiments

The present disclosure is not limited to the above exemplary embodiments. Various modifications (including the organic combinations of the exemplary embodiments) can be made based on the spirit of the present disclosure, and are not to be excluded from the scope of the present disclosure.

The above exemplary embodiments have the following configuration. The exhaust air duct 1 provided around the fixing device 200 and including the discharge opening 1*a* for discharging air inside the apparatus to outside the apparatus is included. Further, the air exhaust fan 2 that is connected to the exhaust air duct 1 and exhausts the air inside the apparatus to discharge the air inside the apparatus to outside the apparatus via the discharge opening 1*a* is included. Then, the filter 3 is provided between the discharge opening 1*a* of the exhaust air duct 1 and the air exhaust fan 2. Then, an example has been described in which the CPU 102 performs the control described above with reference to FIG. 7 or 9, taking into account whether the extent of the progress of the clogging of the filter 3 provided between the discharge opening 1*a* of the exhaust air duct 1 and the air exhaust fan 2 has a tendency to be actually great.

On the other hand, the present disclosure can also be similarly applied to a variation example obtained by correctly reversing the relationship between exhaust air and supply air according to the above exemplary embodiments. This variation example has the following configuration. In this variation example, a supply air duct provided around the fixing device 200 and including a supply opening for supplying air outside the apparatus to inside the apparatus may be included. Further, an air supply fan that is connected to the supply air duct and supplies the air outside the apparatus to inside the apparatus via the supply opening may be included. Then, the filter 3 may be provided between the supply opening of the supply air duct and the air supply fan. Then, the CPU 102 may perform the control described above with reference to FIG. 7 or 9, taking into account whether the extent of the progress of the clogging of the filter 3 provided between the supply opening of the supply air duct and the air supply fan has a tendency to be actually great.

Further, the above exemplary embodiments have been described using as an example of the image forming apparatus 42 having a configuration in which, as illustrated in FIG. 1, the intermediate transfer belt 27B is used as an intermediate transfer member. The present disclosure, however, is not limited to this. The present disclosure can also be applied to an image forming apparatus having a configuration in which a recording material is brought into direct contact with the photosensitive drums 28Bk, 28C, 28M, and 28Y in this order, and images are transferred onto the recording material. The present disclosure can be applied to any image forming apparatus 42 including the developing device 41Bk, regardless of whether the image forming apparatus 42 is a monochrome printer or a color printer.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-131067, filed Jul. 10, 2018, which is hereby incorporated by reference herein in its entirety.

What is claimed is:

1. An image forming apparatus comprising:

an image forming unit configured to execute an image forming operation to form a toner image and including an image bearing member and a developing device, wherein the developing device is configured to accommodate developer containing toner and to develop, using the developer, an electrostatic latent image formed on the image bearing member;

an image heating device configured to fix the toner image onto a recording material by heating the toner image transferred from the image forming unit onto the recording material;

a duct provided around the image heating device and including a discharge opening for discharging air inside the image forming apparatus to outside the image forming apparatus;

an air exhaust fan connected to the duct and configured to exhaust the air inside the image forming apparatus to outside the image forming apparatus via the discharge opening;

a filter provided between the discharge opening and the air exhaust fan and configured to collect a floating substance;

a first detection unit configured to detect an ambient temperature inside the image forming apparatus;

a second detection unit configured to detect an ambient temperature outside the image forming apparatus;

a display unit; and a controller configured to control the display unit, wherein, to display information regarding replacement of the filter, the controller controls the display unit based on the detected inside ambient temperature and the detected outside ambient temperature, wherein, in a case where the image forming unit starts to execute the image forming operation when the detected outside ambient temperature is a first temperature and where the detected inside ambient temperature reaches a predetermined temperature during execution of the image forming operation, the controller controls the display unit such that the filter replacement information is displayed at a first timing after the image forming unit starts to execute the image forming operation, and wherein, in a case where the image forming unit starts to execute the image forming operation when the detected outside ambient temperature is a second temperature higher than the first temperature and where the detected inside ambient temperature reaches the predetermined temperature during execution of the image forming operation, the controller controls the display unit such that the filter replacement information is displayed at a second timing that is earlier than the first timing after the image forming unit starts to execute the image forming operation.

2. The image forming apparatus according to claim 1, wherein, based on the detected inside ambient temperature, the detected outside ambient temperature, and information regarding a grammage of the recording material onto which the toner image heated by the image heating device is to be transferred, the controller controls the display unit to display the filter replacement information, wherein, in a case where the image forming unit starts to execute the image forming operation onto a first recording material when the detected outside ambient temperature is the first temperature and where the detected inside ambient temperature reaches the predetermined temperature during execution of the image forming operation onto the first recording material by the image forming unit, the controller controls the display unit such that the filter replacement information is displayed at a third timing after the image forming unit starts to execute the image forming operation onto the first recording material, and wherein, in a case where the image forming unit starts to execute the image forming operation onto a second recording material that has greater grammage than the first recording material when the detected outside ambient temperature is the first temperature and where the detected inside ambient temperature reaches the predetermined temperature during execution of the image forming operation onto the second recording material by the image forming unit, the controller controls the display unit such that the filter replacement information is displayed at a fourth timing that is earlier than the third timing after the image forming unit starts to execute the image forming operation onto the second recording material.

3. An image forming apparatus comprising:

an image forming unit configured to execute an image forming operation to form a toner image and including an image bearing member and a developing device, wherein the developing device is configured to accommodate developer containing toner and to develop, using the developer, an electrostatic latent image formed on the image bearing member;

an image heating device configured to fix the toner image onto a recording material by heating the toner image transferred from the image forming unit onto the recording material;

a duct provided around the image heating device and including a supply opening for supplying air outside the image forming apparatus to inside the image forming apparatus;

an air supply fan connected to the duct and configured to supply the air outside the image forming apparatus to inside the image forming apparatus via the supply opening;

a filter provided between the supply opening and the air supply fan and configured to collect a floating substance;

a first detection unit configured to detect an ambient temperature inside the image forming apparatus;

a second detection unit configured to detect an ambient temperature outside the image forming apparatus;

a display unit; and a controller configured to control the display unit, wherein, to display information regarding replacement of the filter, the controller controls the display unit based on the detected inside ambient temperature and the detected outside ambient temperature, wherein, in a case where the image forming unit starts to execute the image forming operation when the detected outside ambient temperature is a first temperature and where the detected inside ambient temperature reaches a predetermined temperature during execution of the image forming operation, the controller controls the display unit such that the filter replacement information is displayed at a first timing after the image forming unit starts to execute the image forming operation, and wherein, in a case where the image forming unit starts to execute the image forming operation when the detected outside ambient temperature is a second temperature higher than the first temperature and where the detected inside ambient temperature reaches the predetermined temperature during execution of the image forming operation, the controller controls the display unit such that the filter replacement information is displayed at a second timing that is earlier than the first timing after the image forming unit starts to execute the image forming operation.

4. The image forming apparatus according to claim 3, wherein, based on the detected inside ambient temperature, the detected outside ambient temperature, and information regarding a grammage of the recording material onto which the toner image heated by the image heating device is to be transferred, the controller controls the display unit to display the filter replacement information, wherein, in a case where the image forming unit starts to execute the image forming operation onto a first recording material when the detected outside ambient temperature is the first temperature and where the detected inside ambient temperature reaches the predetermined temperature during execution of the image forming operation onto the first recording material by the image forming unit, the controller controls the display unit such that the filter replacement information is displayed at a third timing after the image forming unit starts to execute the image forming operation onto the first recording material, and wherein, in a case where the image forming unit starts to execute the image forming operation onto a second recording material that has greater grammage than the first recording material when the detected outside ambient temperature is the first temperature and where the detected inside ambient temperature reaches the predetermined temperature during execution of the image forming operation onto the second recording material by the image forming unit, the controller controls the display unit such that the filter replacement information is displayed at a fourth timing that is earlier than the third timing after the image forming unit starts to execute the image forming operation onto the second recording material.

5. An image forming apparatus comprising: an image forming unit configured to execute an image forming operation to form a toner image and including an image bearing member and a developing device, wherein the developing device is configured to accommodate developer containing toner and to develop, using the developer, an electrostatic latent image formed on the image bearing member;

a duct provided around the image forming unit and including a discharge opening for discharging air inside the image forming apparatus to outside the image forming apparatus;

an air exhaust fan connected to the duct and configured to exhaust the air inside the image forming apparatus to outside the image forming apparatus via the discharge opening;

a filter provided between the discharge opening and the air exhaust fan and configured to collect a floating substance;

a first detection unit configured to detect an ambient temperature inside the image forming apparatus;

a second detection unit configured to detect an ambient temperature outside the image forming apparatus;

a display unit; and a controller configured to control the display unit, wherein, to display information regarding replacement of the filter, the controller controls the display unit based on the detected inside ambient temperature and the detected outside ambient temperature, wherein, in a case where the image forming unit starts to execute the image forming operation when the detected outside ambient temperature is a first temperature and where the detected inside ambient temperature reaches a predetermined temperature during execution of the image forming operation, the controller controls the display unit such that the filter replacement information is displayed at a first timing after the image forming unit starts to execute the image forming operation, and wherein, in a case where the image forming unit starts to execute the image forming operation when the detected outside ambient temperature is a second temperature higher than the first temperature and where the detected inside ambient temperature reaches the predetermined temperature during execution of the image forming operation, the controller controls the display unit such that the filter replacement information is displayed at a second timing that is earlier than the first timing after the image forming unit starts to execute the image forming operation.

6. An image forming apparatus comprising: an image forming unit configured to execute an image forming operation to form a toner image and including an image bearing member and a developing device, wherein the developing device is configured to accommodate developer containing toner and to develop, using the developer, an electrostatic latent image formed on the image bearing member;

a duct provided around the image forming unit and including a supply opening for supplying air outside the image forming apparatus to inside the image forming apparatus;

an air supply fan connected to the duct and configured to supply the air outside the image forming apparatus to inside the image forming apparatus via the supply opening;

a filter provided between the supply opening and the air supply fan and configured to collect a floating substance;

a first detection unit configured to detect an ambient temperature inside the image forming apparatus;

a second detection unit configured to detect an ambient temperature outside the image forming apparatus;

a display unit; and a controller configured to control the display unit, wherein, to display information regarding replacement of the filter, the controller controls the display unit based on the detected inside ambient temperature and the detected outside ambient temperature, wherein, in a case where the image forming unit starts to execute the image forming operation when the detected outside ambient temperature is a first temperature and where the detected inside ambient temperature reaches a predetermined temperature during execution of the image forming operation, the controller controls the display unit such that the filter replacement information is displayed at a first timing after the image forming unit starts to execute the image forming operation, and wherein, in a case where the image forming unit starts to execute the image forming operation when the detected outside ambient temperature is a second temperature higher than the first temperature and where the detected inside ambient temperature reaches the predetermined temperature during execution of the image forming operation, the controller controls the display unit such that the filter replacement information is displayed at a second timing that is earlier than the first timing after the image forming unit starts to execute the image forming operation.

* * * * *